US007274008B2

(12) United States Patent
Arnal Valero et al.

(10) Patent No.: US 7,274,008 B2
(45) Date of Patent: Sep. 25, 2007

(54) INDUCTION HOB WITH MONOBLOC HOUSING COMPONENTS

(75) Inventors: Adolfo Arnal Valero, Saragossa (ES); Alejandro Jesus Ferrer Salillas, Saragossa (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/539,542

(22) PCT Filed: Jun. 23, 2003

(86) PCT No.: PCT/EP03/06594

§ 371 (c)(1),
(2), (4) Date: Mar. 17, 2006

(87) PCT Pub. No.: WO2004/060020

PCT Pub. Date: Jul. 15, 2004

(65) Prior Publication Data

US 2006/0163244 A1 Jul. 27, 2006

(30) Foreign Application Priority Data

Dec. 20, 2002 (ES) ..... 200203049

(51) Int. Cl.
*H05B 6/12* (2006.01)

(52) U.S. Cl. ..... 219/622; 219/624; 219/649; 219/452.11; 99/451

(58) Field of Classification Search ..... 219/621–624, 219/649, 451.1, 452.11; 99/DIG. 14, 451
See application file for complete search history.

(56) References Cited

U.S. PATENT DOCUMENTS 4,549,052 A 10/1985 Simon
5,665,263 A * 9/1997 Gaspard ..... 219/622

FOREIGN PATENT DOCUMENTS

DE 196 04 436 A1 8/1997
EP 0 449 347 A1 10/1991
EP 0 936 843 A2 8/1999

OTHER PUBLICATIONS

International Search Report for PCT/EP2003/006594.

* cited by examiner

*Primary Examiner*—Philip H. Leung
(74) *Attorney, Agent, or Firm*—Russell W. Warnock; Craig J. Loest; James E. Howard

(57) ABSTRACT

An induction hob comprising a hotplate, beneath which at least one induction mechanism is situated in a housing. The housing comprises a base and lateral walls that project vertically and are connected to the hotplate. The walls delimit an inner chamber of their corresponding housing containing the induction mechanism. At least one sub-section of the housing base is configured as a one-piece plastic section.

20 Claims, 8 Drawing Sheets

INDUCTION HOB WITH MONOBLOC HOUSING COMPONENTS

OBJECT OF THE INVENTION

The present invention relates to, as specified in the description, an induction hob, with which the production of the housing, including the induction mechanism and various structural parts, is to be simplified such that the housing can be manufactured in just a few working steps with a high degree of measuring precision.

GENERAL PRIOR ART

There are domestic induction hobs known, in which a container, which is arranged on the hotplate, is heated in complete absence of a heat source. In the case of these hobs a hotplate is provided, on which the containers to be heated are arranged, and under which at least one induction mechanism is provided, which is the main component, by means of which heating takes place. As with other types of hob, the corresponding hotplate is fixed in an opening of the work surface. The above mentioned structural parts and the induction mechanism are arranged in a housing, which has a floor connected to the hotplate and lateral walls delimiting a space, in which the induction mechanism is arranged or mounted.

The structure of the housing and its assembly have drawbacks to the extent that a series of considerably complex procedures is required to prolong the assembly work time. Also it is necessary due to the different dimensions and types of devices to provide different housings, which have different dimensions with respect to wall thickness. On the other hand the arranging of different elements on the plate is necessary for assembly of the hotplate, said elements having different functions and being produced independently of the housing, which contains the induction mechanism.

DESCRIPTION OF THE INVENTION

To attain the goals and avoid the disadvantages specified in the foregoing paragraphs, the invention comprises a hob with a hotplate, under which at least one induction mechanism is arranged, which is arranged in a housing, which housing has a housing floor and vertically projecting lateral walls connected to the hotplate, which delimit a housing interior, in which the induction mechanism is arranged.

According to the present invention at least a partial region of the housing floor is designed as a monobloc plastic profile part.

According to the present invention the plastic profile part carries hob components of the induction mechanism.

According to the present invention the plastic profile part is connected to a hob frame.

By way of novelty the above mentioned housing according to the present invention is designed as a monobloc plastic profile part.

By way of novelty the shaping and/or material thickness of the plastic profile part according to the present invention varies and is adapted according to the respective functional requirements.

At least one functional element for reducing the number of components can be designed monobloc on the housing.

The functional element can be connected to the housing monobloc via a nominal point of separation.

After separation of the functional element at the nominal point of separation the functional element is mounted ready for use on the housing, preferably clamped and/or screwed.

The functional element is designed as a locking element, with which at least one hob component, for example an induction mechanism carrier, cool-air fan or electronic control unit, is fixed detachably in the housing.

The locking element has a ramp inclination, along which the hob component is guided into locked connection with the locking element.

The locking element can be connected to the housing via a spring-elastic connecting leg.

The locking element is designed with a lateral stop, which is attached to the induction mechanism carrier for localised mounting of an induction mechanism carrier parallel to the hotplate.

The locking element has a height stop, by which the height position of the hob components is fixed in the housing. This locking element can be assigned a compression spring, which presses the induction mechanism carrier against the height stop with a spring force directed at the hotplate.

When the hotplate is disassembled, the induction mechanism carrier is pressed against the height stop into an assembly position by means of the compression spring.

When the hotplate is assembled it presses the induction mechanism carrier into an operating position under the assembly position.

The lateral stop of the locking element guides the induction mechanism carrier vertically when shifted between the assembly position and the operating position or during assembly or disassembly.

The functional element is designed as a bearing element for bearing the hob in a work surface section.

The functional element is designed as a bulkhead for cool-air flow.

The functional element is designed as a strain relief for cables.

According to the present invention the hob is a mixed hob.

With the described configuration the inventive hob has the advantage that enables the housing to be manufactured simply in few working steps and with a high degree of precision. Also adaptation can occur simply through the correspondingly adapted injection moulding moulded parts. The adapted shaping decreases the danger of the housing warping due to thermal stress or due to mechanical tension.

On the other hand without much additional expenditure functional elements, i.e. other elements for assembly of the induction hob and the hob assembly can be designed in a work surface section to yet further reduce assembly expenditure. An added advantage is that after the housing has taken shape the functional element can be separated from the housing in a simple manner, advantageously and without use of a tool. A further advantage is that both the housing and the additionally required functional elements, such as fastening elements for mounting current cables, can be made by a single working procedure. Material expenditure, manufacturing expense and manufacturing costs can be reduced thereby.

The hob component is to be fixed in the housing during assembly and can easily be disassembled from the housing. Assembly/disassembly of the hob components therefore takes place quickly, without much effort, and reliably all the same. According to an advantageous configuration of the invention further ease of assembly comes about from each locking element being provided with an inclined face. The latter can be brought into contact with an edge of the hob component with assembly of the hob components. Then the edge of the hob component can be guided along the inclined face in locking engagement with the locking element.

In an advantageous embodiment of the invention the locking element is connected to the housing via an elastic connecting leg. After it is taken out of its original position and the hob component is snapped in, the locking projection automatically snaps back into in its original position. If required, possible excess of the hob components is also equalised by elastic deforming of the connecting leg. Hob components, which are made with greater manufacturing tolerances, can also be held securely by the locking element.

By comparison, a factory pre-mounted unit is easily produced, without concern over displacement of the induction mechanism carrier in the housing. The hob components are easily fixed in a vertical direction. Manufacturing tolerances can be equalised through elastic pressure against the induction mechanism carrier. Also it is ensured that the induction mechanism is positioned against the underside of the hotplate.

A further advantage of the invention is the ease of assembly when shifting the induction mechanism carrier between the assembly position and the operating position or during assembly or disassembly.

Further advantages of the invention are that the housing is imparted increased functionality and an additional spoiler is kept inside the housing.

For a clearer understanding of the description and as a constituent of same some figures are attached hereinbelow, in which the object of the invention is illustrated by way of example and in a non-limiting manner.

DESCRIPTION OF EMBODIMENTS OF THE INVENTION

Figure 1:
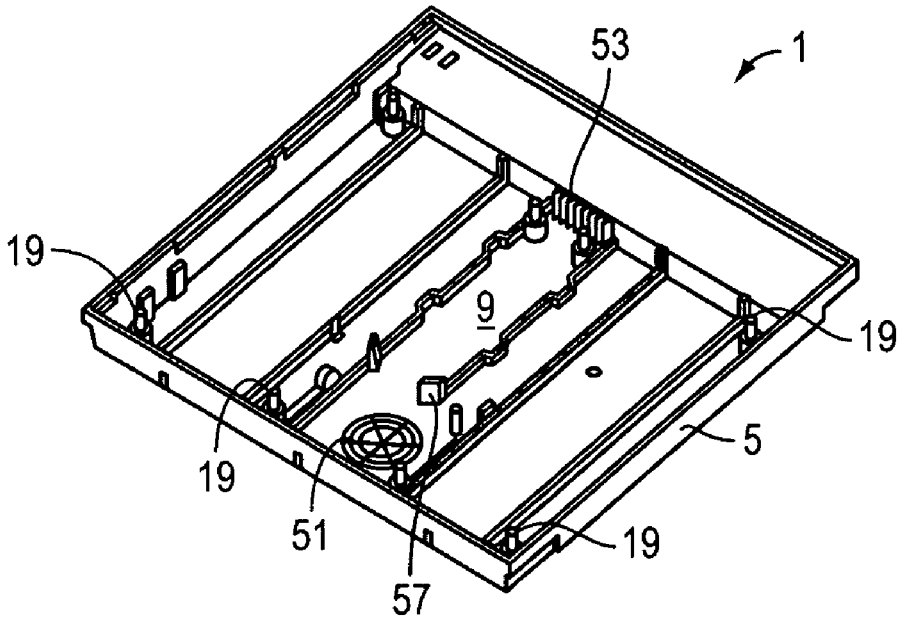
FIG. 1 is a perspective view of the housing, which includes the plate and the induction elements of the hob of the example of the present document.
Figure 2:
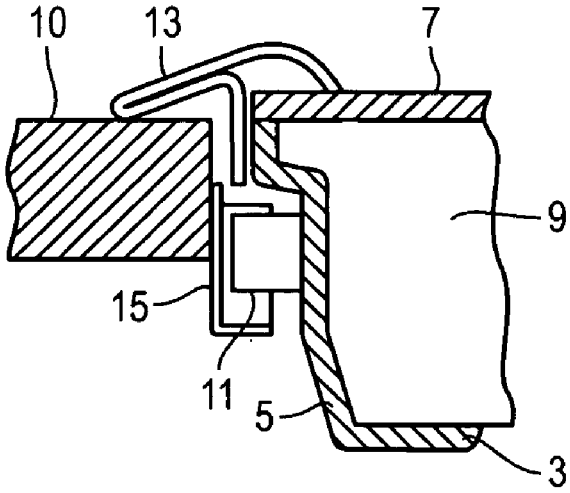
FIG. 2 is a partial sectional view of the hob, shown in FIG. 1, in its arrangement on the corresponding work surface.
Figure 3:
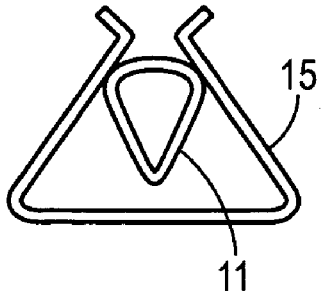
FIG. 3 shows a leaf spring with a bearing body in its interior, used in the example of the invention.
Figure 4:
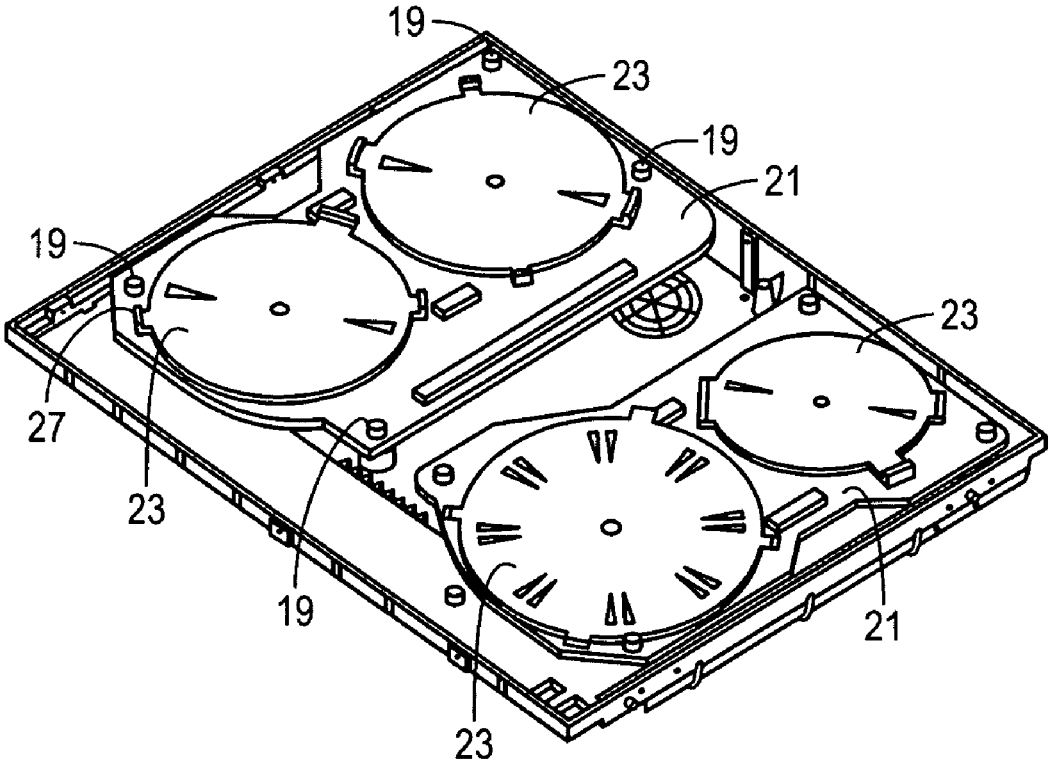
FIG. 4 is a perspective view of the housing of FIG. 1, when the plate and the induction elements are housed therein.
Figure 5:
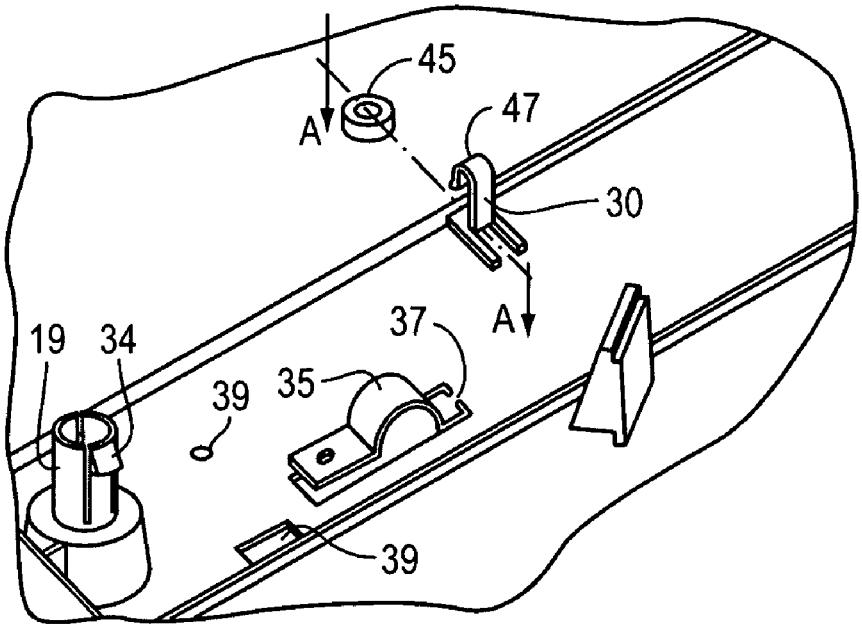
FIG. 5 shows a detail of the hob of the present example, in which apart from the other elements, locking elements, a cable mounting and a nominal point of separation are evident.
Figure 6:
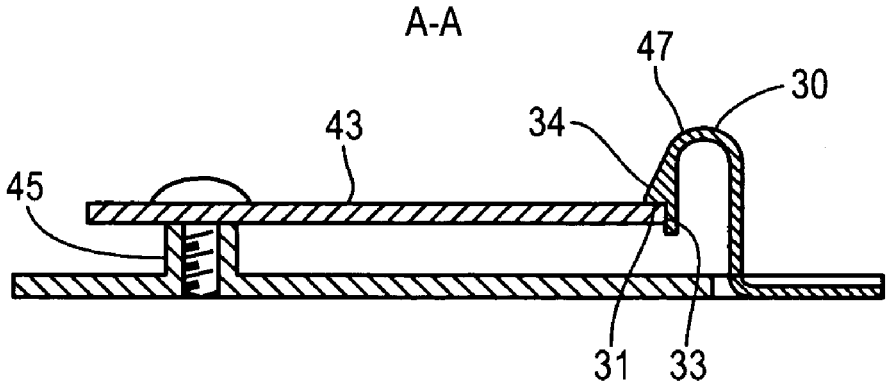
FIG. 6 shows a section according to section A-A, shown in the previous FIG. 5.
Figure 7:
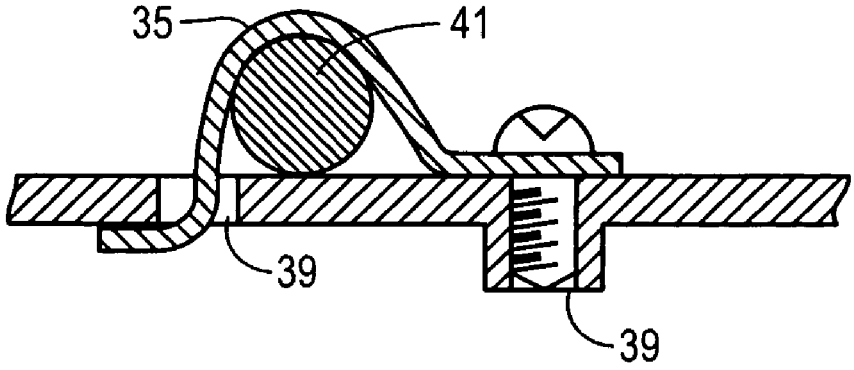
FIG. 7 shows a section of the cable mounting, shown in the previous FIG. 5.
Figure 8:
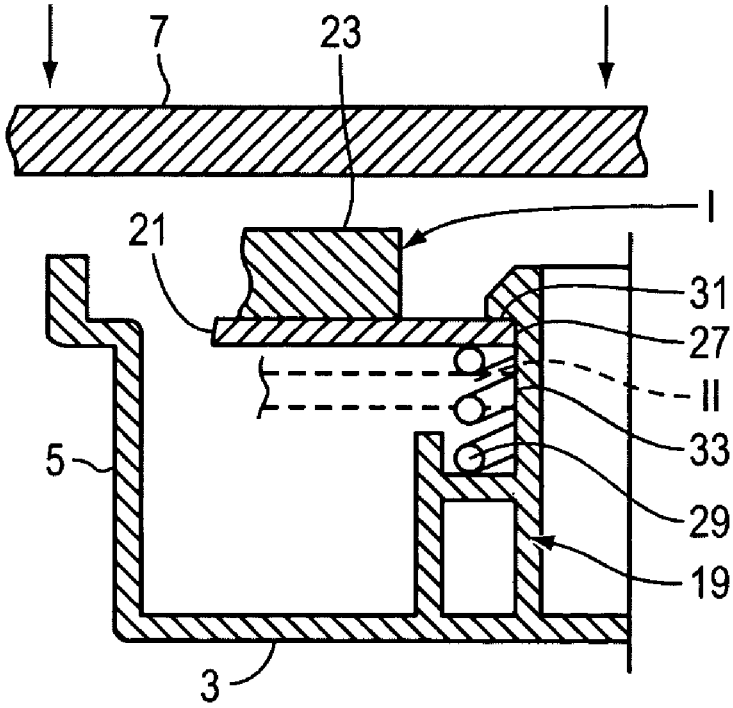
FIG. 8 schematically shows an assembly position (I) and an operating position (II) in the hob of the present example.
Figure 9:
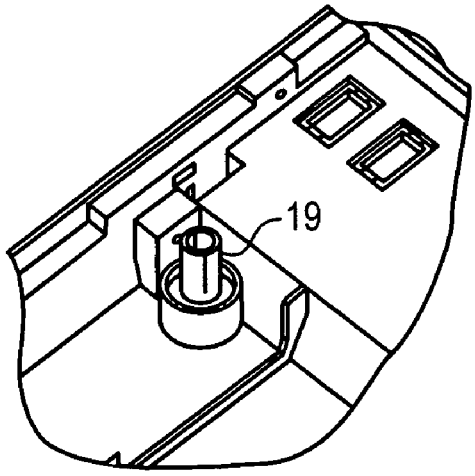
FIG. 9 is a perspective view of some locking elements in the hob of the present example.
Figure 10:
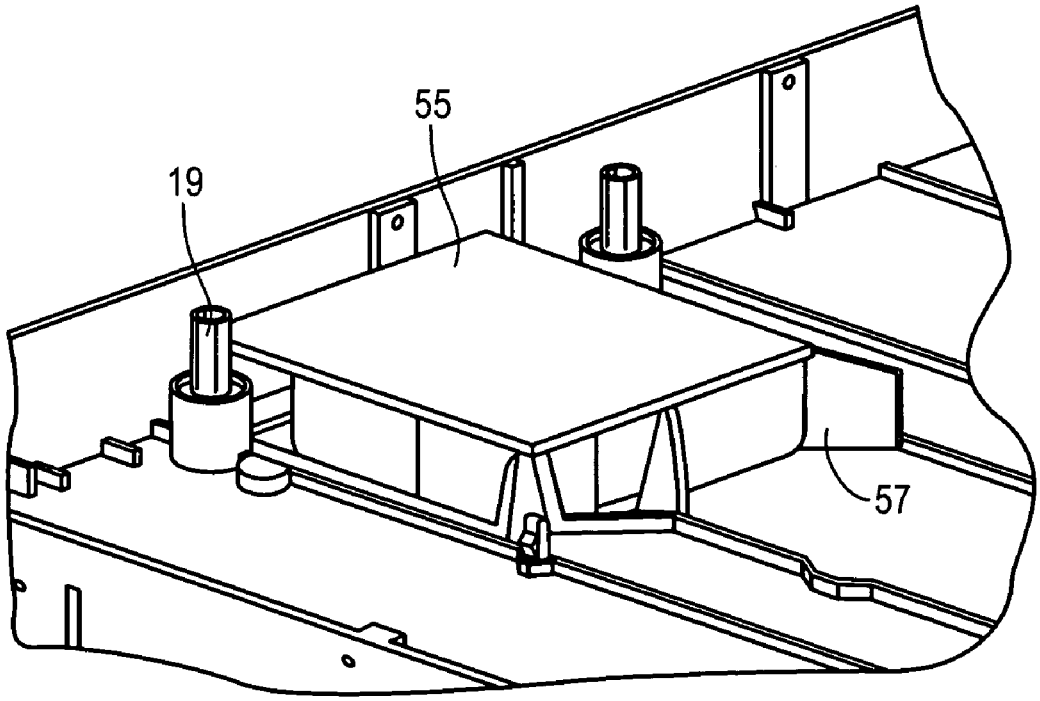
FIG. 10 is a perspective view of a fan and some cool-air baffles.

An example of the invention is described in the following with reference to the reference numerals used in the figures.

Accordingly the induction hob of this embodiment has a housing 1 and a housing floor 3 and vertically projecting lateral walls 5, whereby the hob is one of those which have a glass ceramic plate 7 with induction elements 23 underneath.

The shaping and the material thickness of the housing 1 could obviously vary according to the requirements in other embodiments.

There are functional elements provided, such as the trunnion 11, the locking elements 19, the cable mountings 35, the locking element 47 and the cool-air baffles 57. These functional elements enable the number of components to be reduced.

In addition the cable holder 35 is connected via a nominal point of separation 37 monobloc to the housing 1.

Following separation of the element 35 the functional element 35 is mounted by clamping and/or screwing at the designated place 37 on the housing 1.

The functional element (19, 47) is designed as a locking element, with at least one hob component, such as an induction mechanism carrier 21, a cool-air fan 55 or an electronic control unit 43, attached detachably in the housing 1.

In addition this functional element (19, 47) has a ramp inclination 34, along which the hob component is guided in a locked connection with this element.

By comparison the locking element (19, 47) is connected to the housing 1 via a spring-elastic connecting leg 30.

A lateral stop 33, which is in contact with the induction mechanism carrier 21 for localised mounting of the induction mechanism carrier 21 parallel to the plate 7, is designed on the multiple locking element (19, 47).

This element (19, 47) has a height stop 31, with which the height position of the hob components is fixed in the housing 1.

Assigned to the locking element 19 is a compression spring 29, which presses the induction mechanism carrier 21 against the height stop 31 with a spring force directed at the hotplate 7.

If the hotplate 7 is disassembled, the induction mechanism carrier 21 is pressed against the height stop 31 by means of the compression spring 29 (operating position I).

If the hotplate 7 is assembled it presses the induction mechanism carrier 21 into a second operating position II under the assembly position I.

The lateral stop 33 of the locking element 19 guides the induction mechanism carrier 21 vertically when shifted between the assembly position I and the operating position II or during assembly or disassembly.

The above functional element is designed as a bearing element 11 for bearing the hob 7 in a section of a work surface 10.

The relevant functional element is designed as a bulkhead 57 for cool-air flow.

In addition a cool-air inlet 51 and a cool-air outlet 53 are evident in the figures.

Figure 11:
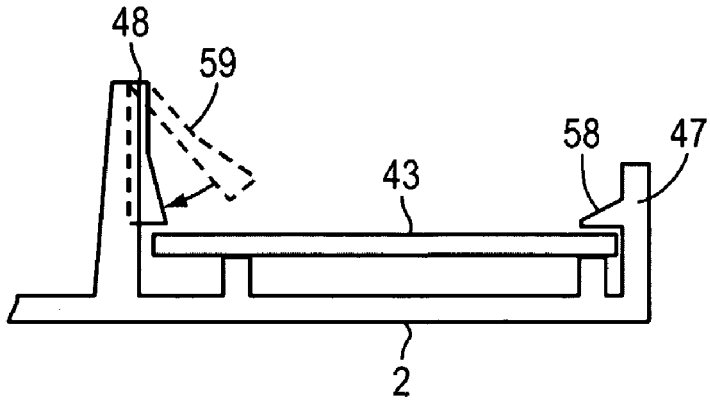
FIG. 11 shows a side elevation of functional elements for mounting an electronic circuit board.

FIG. 11 is a side elevation of functional elements 47, 48 for mounting an electronic circuit board 43. The functional element 47 on the right side is held by the electronic circuit board 43 under a latching tab 58 of the functional element 47. On the left side the electronic circuit board 43 is held clamped by a spring-elastic pin 59 of the functional element 48, which can be moved out of its rest position against the illustrated arrow direction to insert the electronic circuit board 43. If the electronic circuit board 43 is inserted, the spring-elastic pin 59 snaps back into its rest position in the arrow direction and thus clamps the electronic circuit board 43 firmly in its position.

Figure 12:
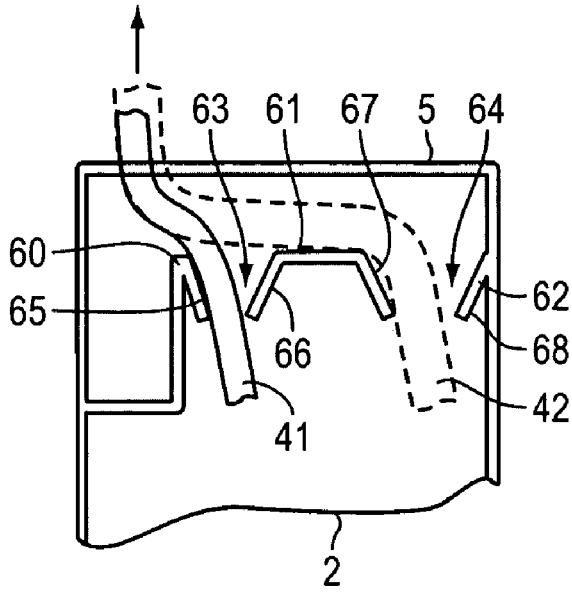
FIG. 12 shows in plan view functional elements for strain relief of cables of varying diameters.

In FIG. 12 functional elements 60, 61, 62 for strain relief of cables 41, 42 of various diameters are shown in plan view. The cables 41, 42 can be threaded in through an opening in the lateral wall 5 of the plastic profile part 2 into the housing 1. A cable 41 of small diameter is guided into a gap 63, formed by an elastic lateral wall 65 of the functional element 60 and by an elastic lateral wall 66 of the functional element 61. A cable 42 with a larger diameter is guided into a gap 64, formed by an elastic lateral wall 67 of the functional element 61 and by an elastic lateral wall 68 of the functional element 62. If strain is exerted on the cable 41 or respectively 42 in the arrow direction, the corresponding gap 63 or respectively 64 is reduced by the elastic lateral walls 65 and 66 or respectively 67 and 68 and thus the cable 41 or respectively 42 is clamped, causing strain relief.

Figure 13:
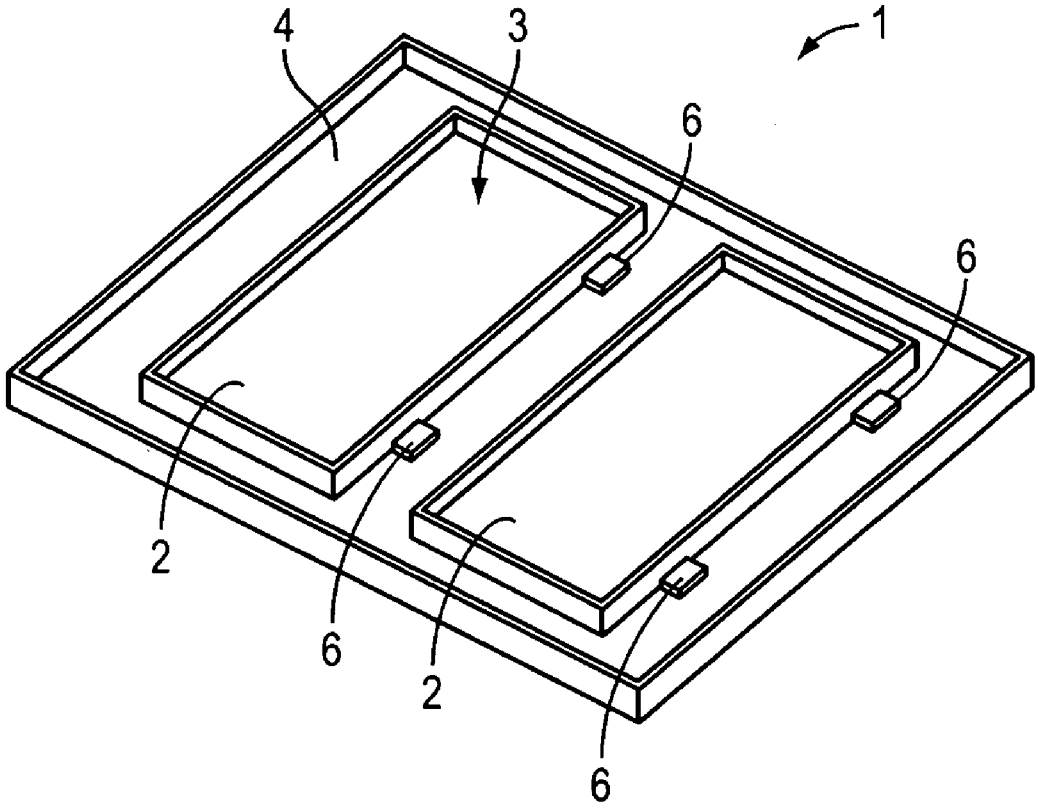
FIG. 13 shows the housing with two monobloc designed plastic profile parts of the housing floor.

In FIG. 13 the housing 1 is shown with two monobloc designed plastic profile parts 2 of the housing floor 3 as an alternative embodiment.

Both plastic profile parts 2 are attached to a hob frame 4 by fastening elements, designed on each of the plastic profile parts 2.

By way of example the plastic profile parts 2 are screwed to the hob frame 4, so that both can be detached from one another again. This facilitates exchange of defective parts.

Figure 14:
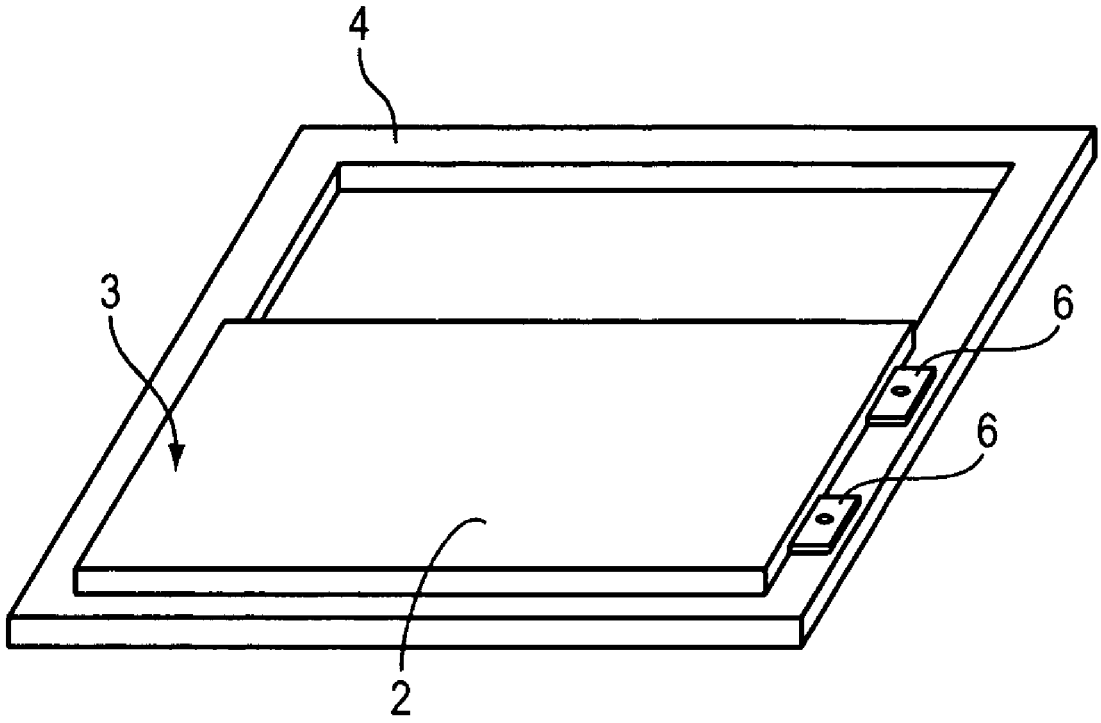
FIG. 14 shows a hob frame with a monobloc designed plastic profile part of the housing floor.

FIG. 14 shows an embodiment of the invention which can be used for mixed hobs, i.e. for hobs, which have apart from at least one cooking point with induction mechanism at least one other cooking point with another type of heating, such as for example a gas hob or a radiated heat source. The monobloc designed plastic profile part 2 to the hob frame 4 for this purpose such that the hob frame 4 still comprises a separate area 8 for the cooking point of the other heating type. In this way for example a housing floor part made of metal can be attached to the hob frame 4 (not shown) for mounting a radiated heat source, which can endure the temperature stress from the radiated heat source. Advantageously the housing floor part made of metal is heat-insulated from the plastic profile part 2 in order to prevent damage to the plastic profile part at high temperatures from the radiated heat source.

In the following list other elements are designated, which are referred to in the figures.

9 Housing interior
13 Edge strip
15 Leaf spring
27 Assembly openings in induction mechanism carriers, through which locking elements 19 are guided
29 Compression spring
39 Recesses for cable holder
41 Cable
45 Screw-in socket

LEGEND

1. Housing
2. plastic profile part
3. housing floor
4. hob frame
5. Vertically projecting lateral walls
6. Fastening element
7. Glass ceramic plate
8. area for other cooking point
9. Housing interior
10. work surface
11. trunnion
13. Edge strip
15. U-shaped leaf spring with two spring legs
19. locking elements
21. induction mechanism carrier
23. induction mechanism
27. Assembly openings in induction mechanism carriers, through which locking elements 19 are guided
29. compression spring
30. Spring-elastic leg
31. Height stop
33. lateral stop
34. Ramp inclination
35. cable holder
37. nominal point of separation
39. Recess for cable holder
41. Cable
42. Cable with large diameter
43. electronic control unit
45. Screw-in socket
47. Additional locking element
48. functional element
51. Cool air inlet
53. Cool air outlet
55. Fan
57. Cool-air baffle
58. Locking tab
59. spring-elastic pin
60. functional element for strain relief
61. functional element for strain relief
62. functional element for strain relief
63. gap for strain relief
64. gap for strain relief
65. elastic lateral wall
66. elastic lateral wall
67. elastic lateral wall
68. elastic lateral wall

The invention claimed is:

1. A hob, comprising:

including at least one hotplate;

at least one induction mechanism arranged under said hotplate;

a housing including a housing floor and substantially vertically projecting lateral walls which delimit a housing interior;

said hotplate connected to said lateral walls;

said induction mechanism arranged in said housing interior; and said housing floor including at least a partial region designed as a monobloc plastic profile part, said housing floor being formed with predetermined structural features formed as functional elements in relief, said functional elements being for placement and mounting of hob components on said housing floor.

2. The hob as claimed in claim 1, including said plastic profile part bears at least one component of said induction mechanism.

3. The hob as claimed in claim 1, including a hob frame and said plastic profile part connected to said hob frame.

4. The hob as claimed in claim 1, including said housing formed as said monobloc plastic profile part.

5. The hob as claimed in claim 1, including at least one of shaping or material thickness of said plastic profile part varies and is adapted according to the respective functional requirements of the hob.

6. The hob as claimed in claim 1, wherein at least one functional element is formed monobloc on said plastic profile part for reducing the number of components of the hob.

7. The hob as claimed in claim 6, wherein said functional element is connected monobloc via a nominal point of separation to said plastic profile part.

8. The hob as claimed in claim 7 wherein after separation of said functional element at said nominal point of separation, said functional element is mounted on said housing by at least one of a clamp or a screw, for use as a separate component.

9. The hob as claimed in claim 6, including said functional element is formed as a locking element, with which at least one hob component, comprising an induction mechanism carrier, a cool-air fan or an electronic control unit is detachably attached to said housing.

10. The hob as claimed in claim 9, including said locking element has a ramp inclination, along which said hob component can be guided into a locked connection with said locking element.

11. The hob as claimed in claims 9, including said locking element is connected to said housing via a spring-elastic connecting leg.

12. The hob as claimed in claims 9, including a lateral stop formed on said locking element, said lateral stop in contact with said an induction mechanism carrier for localised mounting of said induction mechanism carrier substantially parallel to said hotplate.

13. The hob as claimed claims 12, including said locking element has a height stop, by which the height position of said hob components is fixed in said housing.

14. The hob as claimed in claim 13, including said locking element having a compression spring, which presses said induction mechanism carrier against said height stop with a spring force directed toward said hotplate.

15. The hob as claimed in claim 14, including when said hotplate is disassembled said induction mechanism carrier is pressed against said height stop by said compression spring into an assembly position (I).

16. The hob as claimed in claim 15, including when said hotplate is assembled said hotplate presses said induction mechanism carrier into an operating position (II) under said assembly position (I).

17. The hob as claimed in claim 16, including said lateral stop vertically guides said induction mechanism carrier when said induction mechanism carrier is shifted between said assembly position (I) and said operating position (II) or respectively during assembly or disassembly.

18. The hob as claimed in claim 6, including said functional element designed as a bearing element for mounting the hob in a work surface section.

19. The hob as claimed in claim 6, including said functional element designed as a bulkhead for a cool-air flow.

20. The hob as claimed in claim 6, including said functional element designed as a strain relief element for at least one cable.

* * * * *